US007420449B2

(12) United States Patent
Menard

(10) Patent No.: US 7,420,449 B2
(45) Date of Patent: Sep. 2, 2008

(54) MIRROR ACTUATING DEVICE FOR PROJECTION SYSTEMS

(75) Inventor: Peter Menard, Arvada, CO (US)

(73) Assignee: OC Oerlikon Balzers AG, Balzers (LI)

( * ) Notice: Subject to any disclaimer, the term of this patent is extended or adjusted under 35 U.S.C. 154(b) by 0 days.

(21) Appl. No.: 11/837,606

(22) Filed: Aug. 13, 2007

(65) Prior Publication Data

US 2008/0042789 A1 Feb. 21, 2008

Related U.S. Application Data

(60) Provisional application No. 60/822,762, filed on Aug. 18, 2006.

(51) Int. Cl.
*H01F 7/08* (2006.01)

(52) U.S. Cl. ..... 335/222; 359/196; 359/198; 359/199; 359/212; 359/213; 359/214; 310/36

(58) Field of Classification Search ..... 335/222; 310/36; 359/196–200, 212–214, 220–226
See application file for complete search history.

(56) References Cited

U.S. PATENT DOCUMENTS 6,856,437 B2 * 2/2005 Witt et al. ..... 359/198

FOREIGN PATENT DOCUMENTS

| | | | |
|---|---|---|---|
| DE | V5871V/68 B | | 6/1956 |
| DE | 2531069 | A1 | 1/1976 |
| DE | 4100358 | A1 | 7/1992 |
| DE | 3784909 | T2 | 9/1993 |
| DE | 69634603 | T2 | 2/2006 |
| EP | 1087248 | A1 | 3/2001 |
| EP | 1215518 | A1 | 6/2002 |
| JP | 200354829 | A | 12/2000 |

OTHER PUBLICATIONS

International Search Report dated Nov. 7, 2007 for application No. PCT/EP2007/006558.
German Search Report Aug. 6, 2007.

* cited by examiner

*Primary Examiner*—Ramon M Barrera
(74) *Attorney, Agent, or Firm*—Pearne & Gordon LLP

(57) ABSTRACT

A magnetic actuator utilizes a single magnet and two voice coils to rotate a mirror between two angular positions with respect to a rest state. A magnetic field assembly applies magnetic flux across the voice coils. An upper plate and a lower plate are held together by a permanent magnet, so that each plate forms a magnetic pole. The voice coils are actuated by feeding current to their coils, resulting in an electromagnetic field being formed around the coils. The voice coils have magnetic flux passing across them, caused by the magnet and the two plates. Hence, the coils move upward or downward according to the current applied. A mirror holder includes a fixed periphery and moving arms attached to a torsional beam spanning the periphery. The arms are moved by the adjacent voice coils, twisting the torsional beam, and the attached mirror moves also.

6 Claims, 7 Drawing Sheets

MIRROR ACTUATING DEVICE FOR PROJECTION SYSTEMS

This application claims the benefit of U.S. provisional patent application Ser. No. 60/822,762 filed Aug. 18, 2006, the contents of which are incorporated herein by reference in their entirety.

BACKGROUND OF THE INVENTION

1. Field of the Invention

This invention relates to an electromagnetic actuator for tilting a surface between angular positions. In particular, this invention relates to mirror actuating devices for rotating a mirror between two angular positions with respect to a rest state, which utilize a single magnet and voice coils, for use in projection systems.

2. Description of Related Art

In the present context, the mirror is moved between two positions in order to double the pixel density of a projected image, by alternating two subframes, each having half of the pixels of the final image. The subframes are slightly offset from each other by the movement of the mirror, for example by having one subframe offset one-half pixel downward relative to the other subframe. The human eye integrates the two consecutive subframes to create the single final image.

While the required mirror rotation is typically very small, it occurs at high accelerations, for example 12G's or more.

In order to realize the forces required, previous motors used in this sort of system have used multiple magnets and numerous moving parts. FIGS. 1A and 1B (Prior Art) illustrate such a prior art device 1 for actuating a mirror in a projector. FIG. 1A shows an assembled device 1 and FIG. 1B shows an exploded view of device 1 of FIG. 1A. In order to accomplish the forces required for mirror actuating, two voice coils 4, four magnets 14, and five pieces of steel (four steel plates 12 and base 16) are required.

As can be seen from the figures, such an assembly comprises many expensive components which are difficult to assemble and due to complexity, might fail during operation.

Therefore a need remains in the art for an electro-magnetic actuator utilizing a simple magnet and coil assembly, for rotating a surface a small amount between angular positions at a high frequency.

SUMMARY

It is therefore an object of the present invention is to provide an electromagnetic actuator utilizing a simple magnet and coil—assembly, for rotating a surface a small amount between angular positions at a high frequency, particularly useful for rotating a mirror between two angular positions with respect to a rest state.

This object is accomplished with a single permanent magnet and voice coil combination. Voice coils are known. While they were developed for use in speakers, they are also used to move elements in various devices, in place of stepper motors and the like. They are used, for example, in hard disk drives, in order to move the head arms in and out over the surface of the platters. The voice coils are actuated by passing current through their coils, resulting in a vertical force being produced by the coils. The air gaps have magnetic flux passing across and bridging them, caused by the magnet and the two plates. Hence, the coils move upward or downward according to the direction of the current applied.

The single permanent magnet according to the present invention comprises an upper surface forming one magnetic pole and a lower surface forming the other magnetic pole. The upper surface has openings for the voice coils and the lower surface has arms extending into the openings of the voice coils. This is an inventive way of producing high flux in the gaps around two voice coil motors of the actuator with only one magnet.

In a preferred embodiment of the present invention the magnet comprises only two pieces of ferromagnetic material such as stamped steel: an upper plate and a lower plate held together by a permanent magnet, so that each plate forms a magnetic pole. The upper plate has openings for the voice coils, and the lower plate has arms extending into the openings and the voice coils. This is an inventive way of producing high flux in the gaps around two voice coil motors of the actuator with only one rare earth magnet and two pieces of ferromagnetic material such as for example stamped steel.

A mirror holder includes a fixed periphery, or outer edge, and moving arms attached to a torsional beam spanning the periphery. The arms are moved by the voice coils, and the mirror is attached to the arms on the other side from the voice coils and so moves also.

DETAILED DESCRIPTION OF EXAMPLE EMBODIMENTS OF THE INVENTION

Figure 1A:
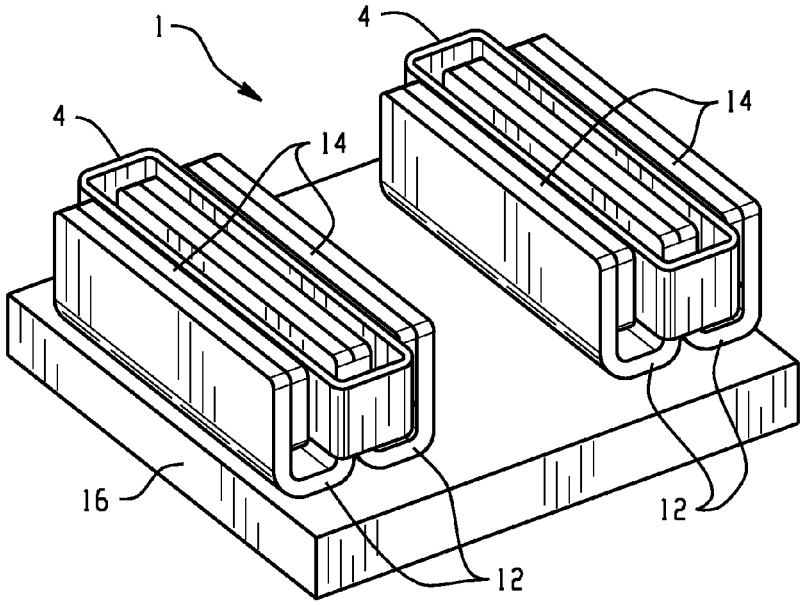
Fig. 1A PRIOR ART
FIG. 1A is an isometric view of a known device for actuating a mirror comprising two voice coils, four magnets, and five pieces of steel.
Figure 1B:
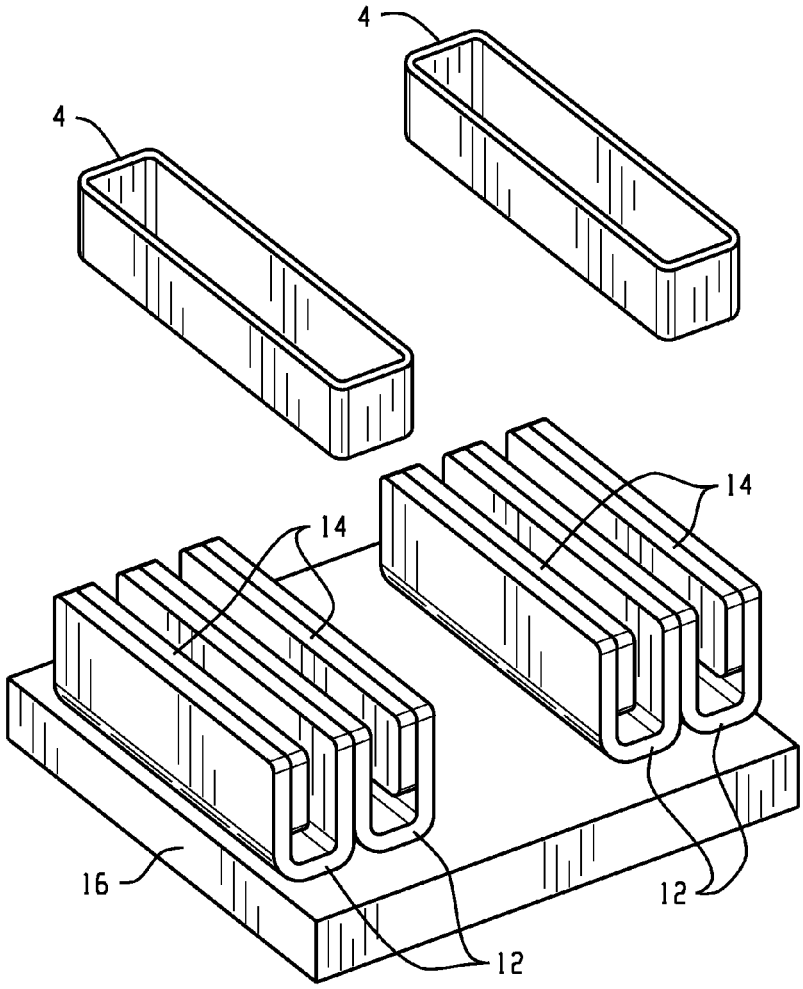
Fig. 1B PRIOR ART
FIG. 1B is an exploded isometric view of the known device of FIG. 1A.
Figure 2A:
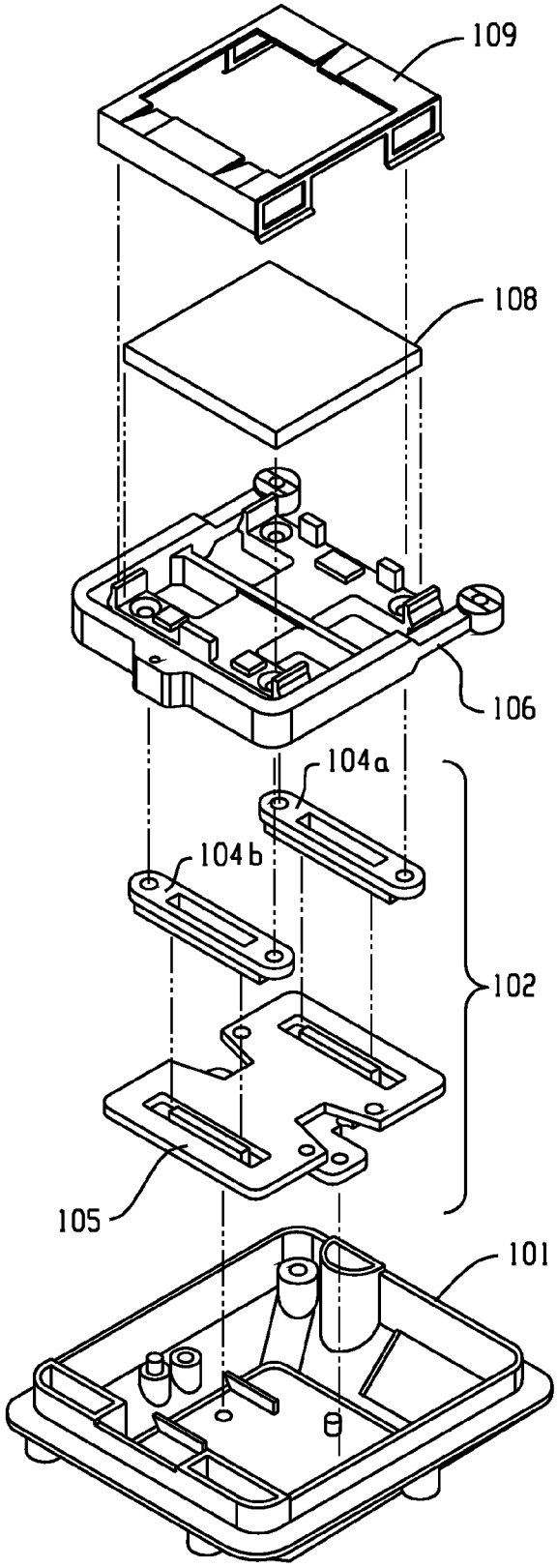
FIG. 2A is an exploded isometric drawing showing a mirror actuator according to the present invention.
Figure 2B:
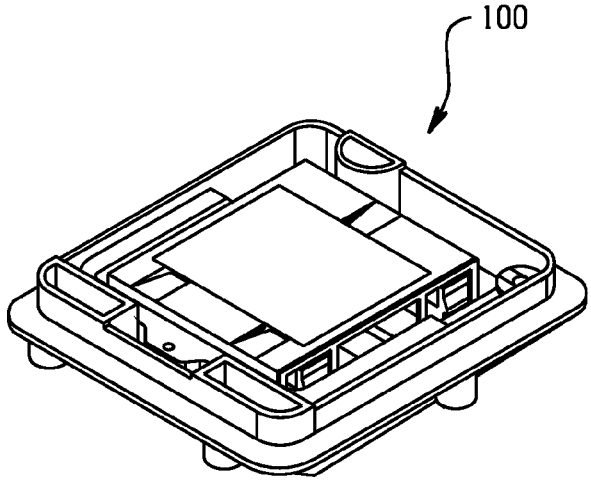
FIG. 2B is an isometric drawing of the mirror actuator of FIG. 2A, assembled.

FIG. 2A is an exploded isometric drawing showing a mirror actuator 100 according to an embodiment of the present invention. FIG. 2B is an isometric drawing of the mirror actuator 100, as assembled.

An actuator housing 101 provides a base for the mirror actuator 100. A mirror retainer 109 snaps into a mirror holder 106 and holds a mirror 108 against the mirror holder 106. A magnetic field assembly 105 (better shown in FIGS. 3 and 4) and two voice coils 104*a*, 104*b* form a motor 102 of the mirror actuator 100. The mirror holder 106 includes a moving portion 122 (better shown in FIG. 9) which twists on a torsional beam 123. The mirror 108 attaches to the moving portion 122 of the mirror holder 106 and moves as it does.

The mirror rotation is typically very small, on the order of 30 to 60 seconds of arc (0.007 to 0.015 degrees). It is similar to a bistable actuator, in that the mirror has two offset positions aside from the rest position. So the mirror rotates about +/−0.015 degrees from rest. This is best shown in FIGS. 5-8. While the amount of rotation is small, it occurs at high accelerations, for example 12G's or more.

Each of the voice coils 104*a*, 104*b* comprises a thin gage of wire wrapped around a bobbin. In one embodiment, each of the voice coils 104*a*, 104*b* comprise about 80 turns of wire. In the embodiment of FIGS. 2A and 2B, the voice coils 104*a*, 104*b* are about 18 mm (about 0.7087 inch) long, about 4 mm (about 0.1575 inch) wide and about 3 mm (about 0.1181 inch) tall, and they operate in the range of 100 to 500 milliamps. This current is provided by circuitry (not shown).

Figure 3:
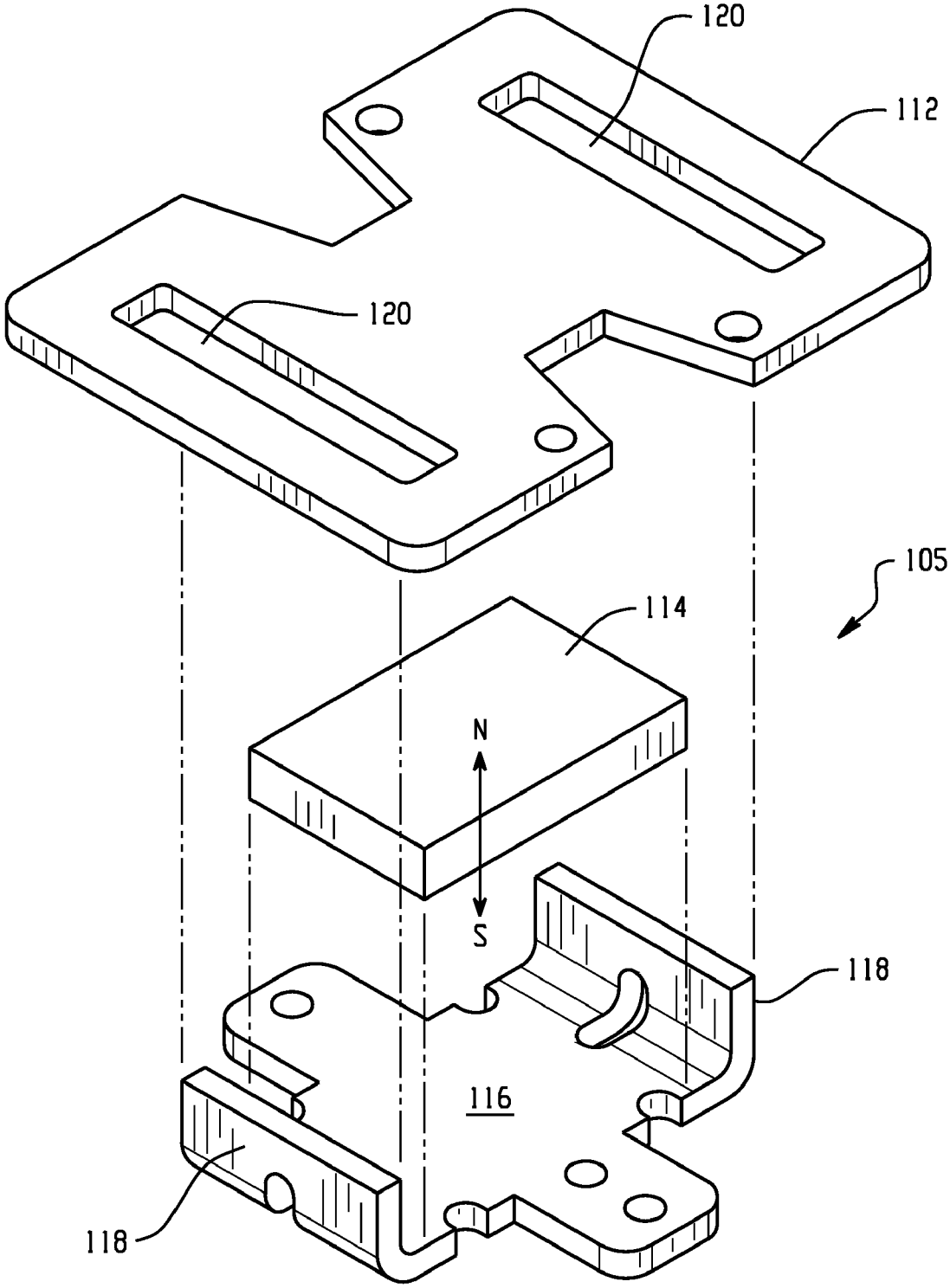
FIG. 3 is an exploded isometric drawing showing the magnet field assembly of the mirror actuator of FIGS. 2A and 2B.

FIG. 3 is an exploded isometric drawing showing the magnetic field assembly 105. The magnetic field assembly 105 acts as a static component of the motor 102 for providing a magnetic field and includes an upper plate 112, a single permanent magnet 114, and a lower plate 116. Note that the term "single magnet" refers to a signal collocated magnetic effect. Two adjacent magnets would generate a signal collocated magnetic effect, and hence constitute a "single magnet" according to this invention.

Figure 4:
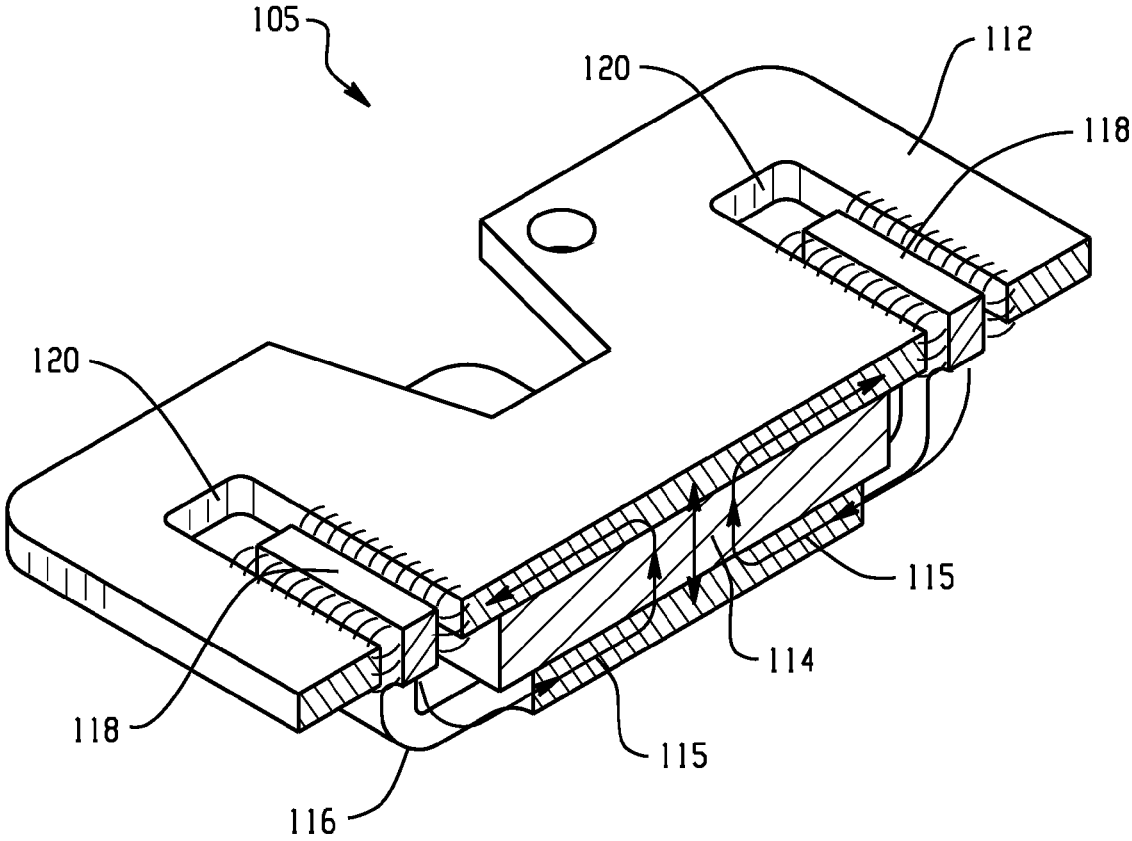
FIG. 4 is a cutaway isometric drawing showing the magnet field assembly of FIG. 3, assembled.

The magnet 114 holds the upper plate 112 and the lower plate 116 together and also provides magnetic flux 115 as shown in FIG. 4. In one embodiment, the magnet is a rare earth magnet, about 3 mm (about 0.1181 inch) thick and about 8 mm (about 0.315 inch) square. The upper plate 112 has openings that the voice coils 104*a*, 104*b* are designed to fit within. The lower plate 116 has arms 118 which extend into openings 120 on the upper plate 112, but which leave an air gap for the voice coils 104*a*, 104*b* (see FIGS. 2A and 2B). The upper plate 112 and the lower plate 116 are typically stamped ferromagnetic metal plates. Thus it is possible to manufacture the magnetic field assembly 105 without machining any parts.

The actuator housing 101 holds the upper plate 112 and the lower plate 116 in a precise spatial relationship via features in the housing to which the upper and lower plates 112, 116 are aligned (not shown) as the magnetic flux passing between plates draws them together. As far as the air gap is concerned, the inner pole (the arms 118 of the lower plate 116) is one pole and the surfaces of the outer pole (the edges of the openings 120 on the upper plate 112) serve as the other pole. For the purposes of discussion herein, the upper plate 112 is defined as North and the lower plate 116 is defined as South, though the reverse would also work.

Note that in the context of moving a mirror between two angular positions from a rest state, a motor constant on the order of 0.1 to 0.2 degrees per ampere is desirable. The design shown in FIGS. 2A, 2B, 3 and 4 provides this capability. Other designs (such as removing the upper plate 112) may also produce movement, but may result in a motor constant that is too low.

FIG. 4 is a cutaway isometric drawing showing the magnetic field assembly 105, assembled. The magnetic flux 115 generated by the magnet 114 is shown. The upper plate 112 is one magnetic pole (North in this example) and the lower plate 116 is the other pole (South). The magnetic flux 115 jumps across and bridges the air gaps between the arms 118 and the openings 120 to operate on the voice coils 104*a*, 104*b* (removed in this figure for clarity). When current is passed through the voice coils 104*a*, 104*b*, they move the moving portion 122 of the mirror holder 106, which twists or pivots about a tilt axis 110 on the torsional beam 123—one side is moved up as the other moves down (see FIGS. 6-9). When the direction of the current flow is reversed, the voice coils 104*a*, 104*b* move the moving portion 122 of the mirror holder 106 in the opposite direction.

Figure 5:
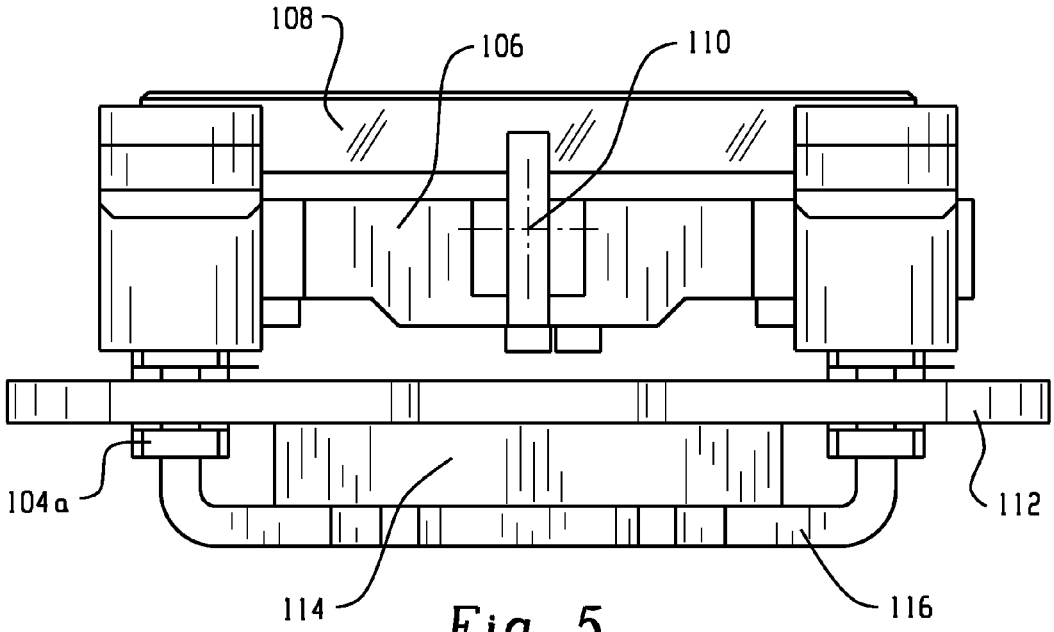
FIG. 5 is a side view of the mirror actuator of FIGS. 2A and 2B, in the rest state.
Figure 6:
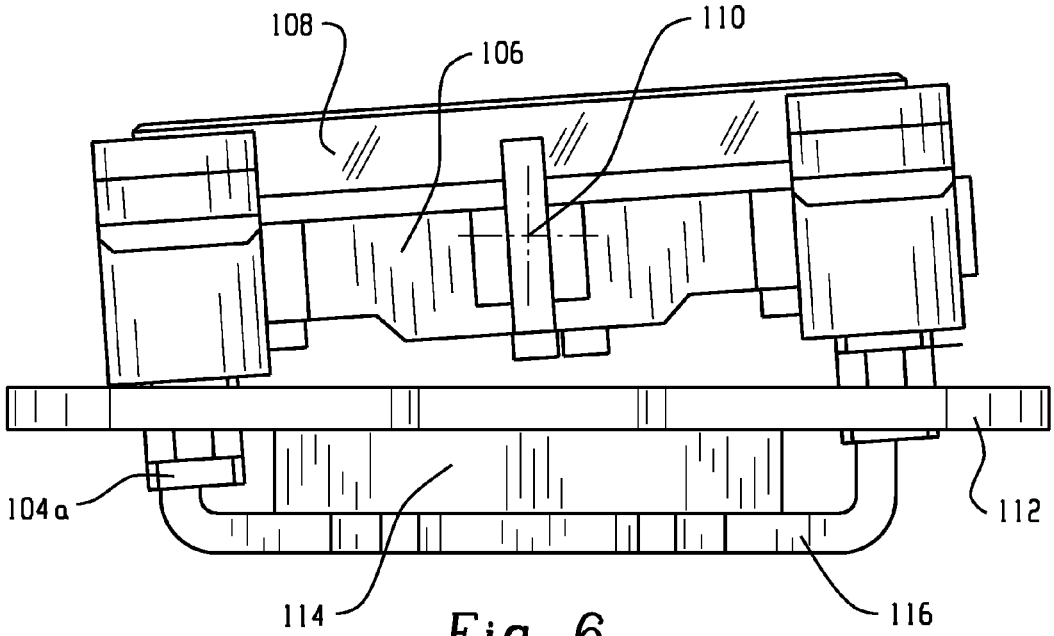
FIG. 6 is a side view of the mirror actuator of FIGS. 2A and 2B, in one of the angular positions.

FIG. 5 is a side view of the mirror actuator 100, in the rest state. The mirror retainer 109 and the actuator housing 101 have been removed for clarity. The tilt axis 110 is shown. FIG. 6 is a side view of the mirror actuator 100, in one of the angular positions. Note that rotation is greatly exaggerated in this figure for illustrative purposes. In the example of FIG. 6, current (for example) is passed through the left-hand voice coil 104*a* and a reverse current is passed through the right-hand voice coil 104*b*. This causes the voice coils 104*a*, 104*b* to produce vertical forces which act to move the voice coils 104*a*, 104*b*, and hence the ends of the mirror holder 106 attached to them, either up (in the case of the right-hand voice coil 104*b*) or down (in the case of the left-hand voice coil 104*a*) relative to the magnetic field in the air gaps caused by the magnet 114.

Figure 7:
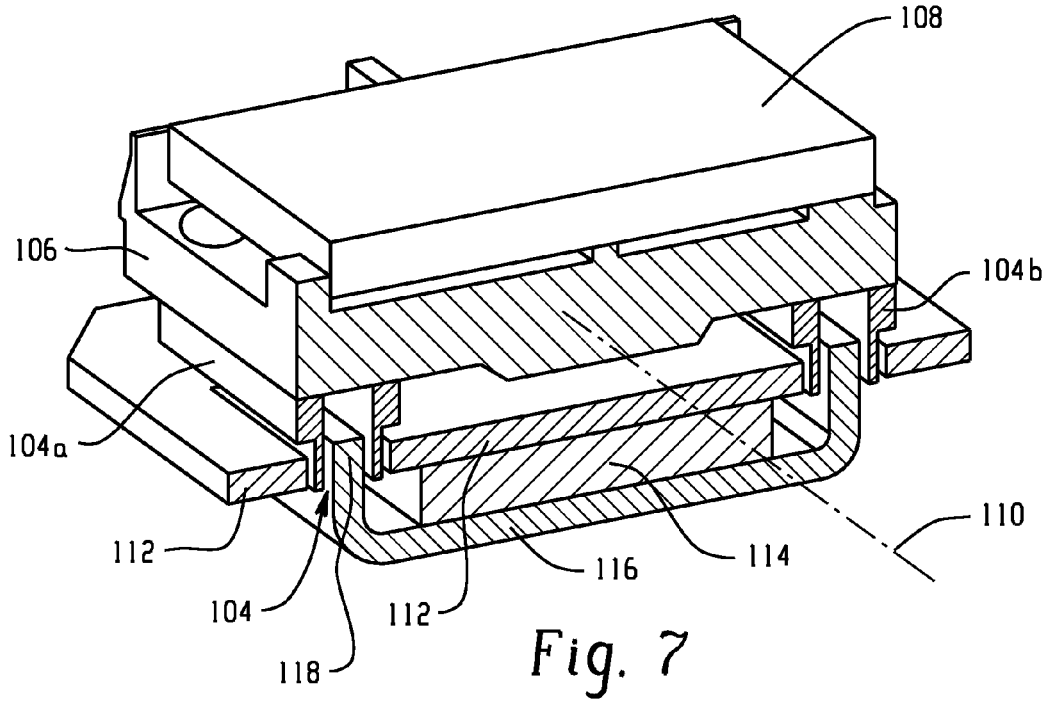
FIG. 7 is a side cutaway isometric view of the mirror actuator of FIGS. 2A and 2B, in the rest state.
Figure 8:
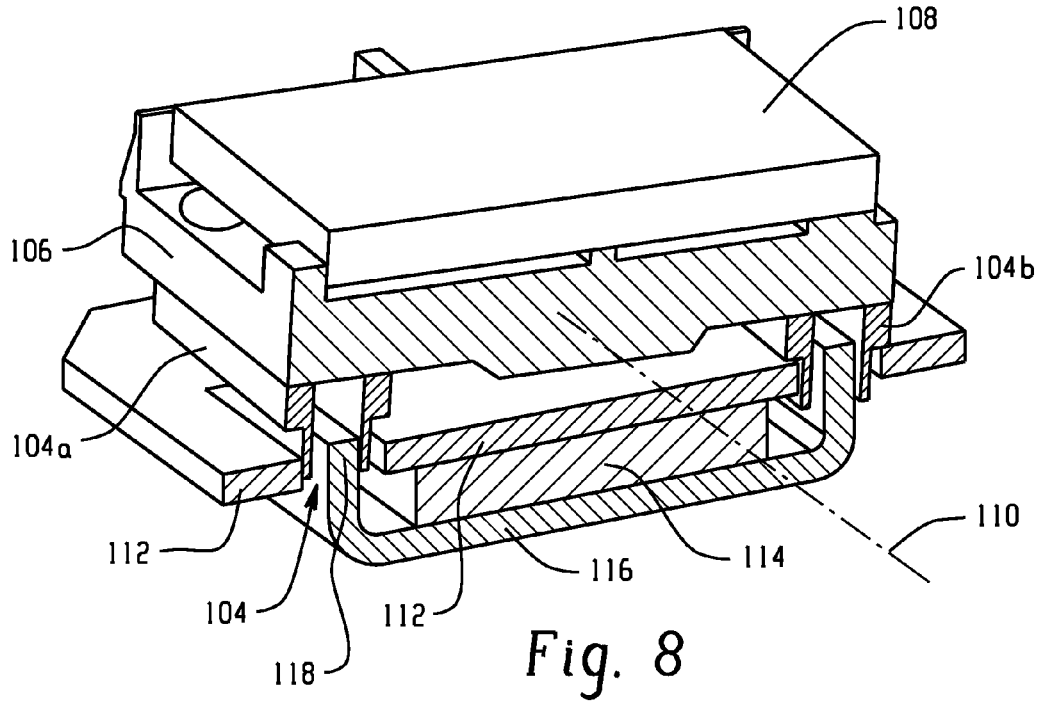
FIG. 8 is a side cutaway isometric view of the mirror actuator of FIGS. 2A and 2B, in one of the angular positions.

FIG. 7 is a side cutaway isometric view the mirror actuator 100, in the rest state. FIG. 8 is a side cutaway isometric view of the mirror actuator 100 in the angular position illustrated in FIG. 6. In these figures, it can be seen that the voice coils 104*a*, 104*b* are arranged on opposite sides of the mirror holder 106 and extend downward inside the openings 120 and around the arms 118 of the lower plate 116. Hence the magnetic flux 115 between the upper plate 112 and the lower plate 116 is at its strongest point where it passes through the voice coils 104*a*, 104*b*.

Figure 9:
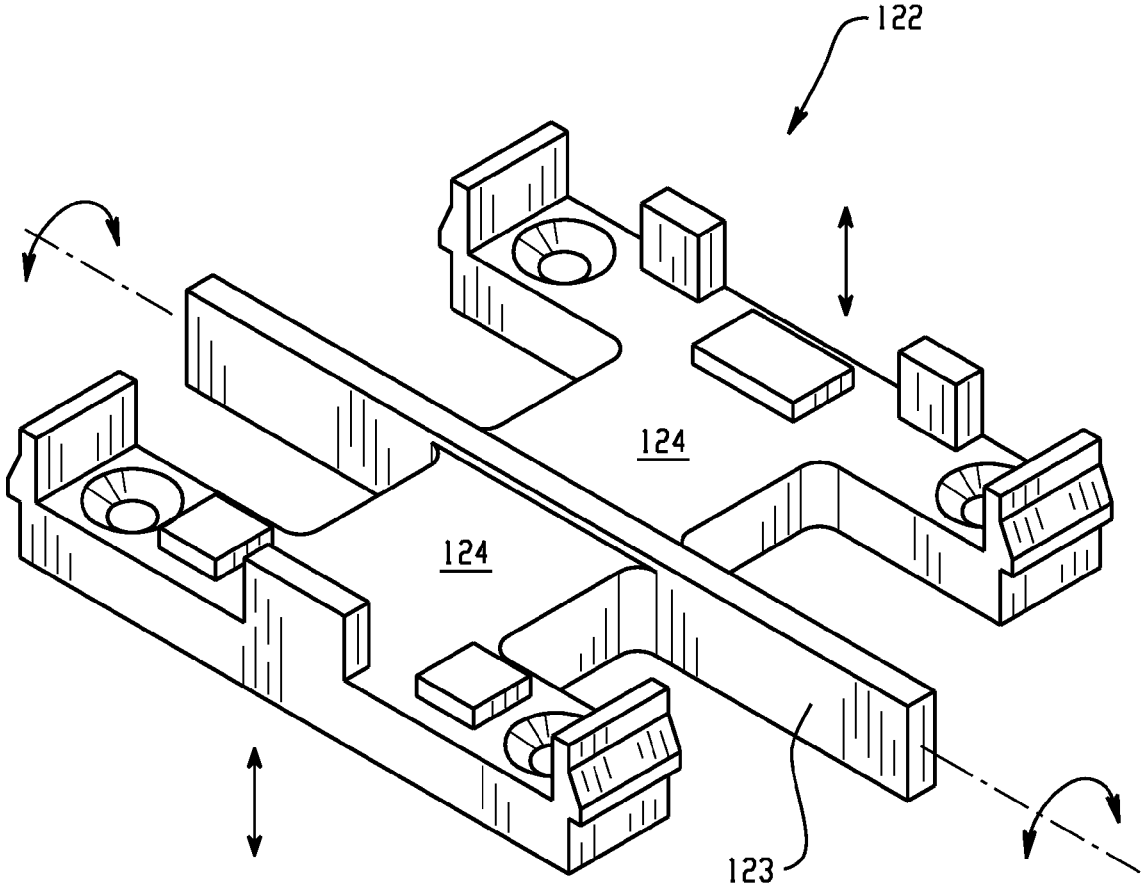
FIG. 9 is a side isometric drawing showing the moving portion of the mirror holder portion of the mirror actuator of FIG. 2A in more detail.

FIG. 9 is a side isometric drawing showing the moving portion 122 of the mirror holder 106 in more detail. The voice coils 104*a*, 104*b* are attached to moving portion 122 and hence they twist together. The torsional beam 123 twists as the voice coils 104*a*, 104*b* apply torque to moving portion arms 124, which extend from the torsional beam 123. The ends of the torsional beam 123 are attached to a periphery 125 of the mirror holder, while the moving portion arms 124, which are attached to the mirror 108, float with respect to the periphery.

The design achieves flexure with only a single, monolithic part (the torsional beam 123) that twists. In a preferred embodiment, the torsional beam 123 is die cast in an aluminum alloy designated 380.0. This achieves a good balance between fabrication cost and strength and performance of the part. The cross section of the torsional beam 123 is 1.5 mm (0.05906 inch) wide and 5.0 mm (0.1969 inch) tall. The torsional beam 123 consists of two halves, each 11 mm (0.4331 inch) long, resulting in the torsional beam 123 being 22 mm (0.8661 inch) long, spanning the periphery 125 of the mirror holder 106.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. An electromagnetic actuator for alternating a mirror between two angular positions, comprising:

a static component for providing a magnetic field, the static component comprising a first magnetic pole and a second magnetic pole, the first magnetic pole comprising a first opening and a second opening, the second magnetic pole comprising a first arm and a second arm, wherein the first arm extends into the first opening leaving a first air gap between the first arm and the first opening, wherein the second arm extends into the second opening leaving a second air gap between the second arm and the second opening, and wherein a magnetic flux bridges the first air gap and the second air gap;

a mirror holder comprising a moving portion that is pivotable about an axis, the mirror being fixed to a moving portion arm of the moving portion; and first and second voice coils arranged at opposite sides of the mirror holder, wherein the static component and the mirror holder are arranged so that the first voice coil at least partially extends into the first air gap and the and second voice coil at least partially extends into the second air gap.

2. The electromagnetic actuator of claim 1, wherein the static component further comprises a permanent magnet, an upper plate and a lower plate, the upper plate forming the first magnetic pole and the lower plate forming the second magnetic pole.

3. The electromagnetic actuator of claim 1, wherein the mirror holder further comprises a torsional beam that permits the moving portion to be pivotable about the axis.

4. The electromagnetic actuator of claim 3, wherein the torsional beam is monolithic.

5. A method for rotating a mirror comprising providing an electromagnetic actuator according to claim 1 and passing current though the first and second voice coils.

6. The method according to claim 5, wherein the mirror achieves accelerations of at least 12 G's.

* * * * *